US010000824B2

(12) United States Patent
Yoshino et al.

(10) Patent No.: US 10,000,824 B2
(45) Date of Patent: Jun. 19, 2018

(54) MATERIAL FOR COLD-ROLLED STAINLESS STEEL SHEET AND PRODUCTION METHOD THEREFOR

(71) Applicant: JFE STEEL CORPORATION, Tokyo (JP)

(72) Inventors: Masataka Yoshino, Chiba (JP); Hiroki Ota, Chita (JP); Ayako Ta, Chiba (JP); Yukihiro Matsubara, Kurashiki (JP); Akito Mizutani, Chiba (JP); Mitsuyuki Fujisawa, Chiba (JP)

(73) Assignee: JFE STEEL CORPORATION, Tokyo (JP)

( * ) Notice: Subject to any disclaimer, the term of this patent is extended or adjusted under 35 U.S.C. 154(b) by 39 days.

(21) Appl. No.: 15/112,901

(22) PCT Filed: Jan. 20, 2015

(86) PCT No.: PCT/JP2015/000240
§ 371 (c)(1),
(2) Date: Jul. 20, 2016

(87) PCT Pub. No.: WO2015/111403
PCT Pub. Date: Jul. 30, 2015

(65) Prior Publication Data

US 2016/0369368 A1 Dec. 22, 2016

(30) Foreign Application Priority Data

Jan. 24, 2014 (JP) ..... 2014-011306
Nov. 11, 2014 (JP) ..... 2014-228503

(51) Int. Cl.
*C21D 9/46* (2006.01)
*C22C 38/52* (2006.01)
(Continued)

(52) U.S. Cl.
CPC ..... *C21D 9/46* (2013.01); *C21D 6/002* (2013.01); *C21D 8/0226* (2013.01);
(Continued)

(58) Field of Classification Search
CPC ..... C22C 38/54; C22C 38/52; C22C 38/50
See application file for complete search history.

(56) References Cited

U.S. PATENT DOCUMENTS

2001/0003293 A1 6/2001 Hirata et al.
2017/0275744 A1* 9/2017 Ta ..... C22C 38/54
2017/0283923 A1* 10/2017 Ta ..... C22C 38/54

FOREIGN PATENT DOCUMENTS

CN 87105997 A 7/1988
CN 1550565 A 12/2004
(Continued)

OTHER PUBLICATIONS

Korean Office Action with partial English language translation for Application No. 2016-7022843, dated Jun. 2, 2017, 4 pages.
(Continued)

*Primary Examiner* — Scott Kastler
(74) *Attorney, Agent, or Firm* — RatnerPrestia

(57) ABSTRACT

A material for stainless steel cold rolling suitable for producing a cold-rolled stainless steel sheet that has sufficient corrosion resistance and ridging resistance as well as excellent formability and surface properties is provided. The material for stainless steel cold rolling according to the present invention contains, in terms of % by mass, C: 0.007% to 0.05%, Si: 0.02% to 0.50%, Mn: 0.05% to 1.0%, P: 0.04% or less, S: 0.01% or less, Cr: 15.5% to 18.0%, Al: 0.001% to 0.10%, N: 0.01% to 0.06%, and the balance being Fe and unavoidable impurities, wherein the material has a microstructure that includes 10% to 60% of a martensite phase in terms of area fraction, with the remainder being a
(Continued)

ferrite phase, and the martensite phase has a hardness of HV500 or less.

4 Claims, 1 Drawing Sheet

(51) Int. Cl.

| | |
|---|---|
| ***C22C 38/00*** | (2006.01) |
| ***C22C 38/18*** | (2006.01) |
| ***C22C 38/54*** | (2006.01) |
| ***C21D 6/00*** | (2006.01) |
| ***C21D 8/02*** | (2006.01) |
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/26*** | (2006.01) |
| ***C22C 38/28*** | (2006.01) |
| ***C22C 38/30*** | (2006.01) |
| ***C22C 38/32*** | (2006.01) |
| ***C22C 38/40*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/24*** | (2006.01) |

(52) U.S. Cl.

CPC ..... *C21D 8/0236* (2013.01); *C21D 8/0247* (2013.01); *C22C 38/00* (2013.01); *C22C 38/001* (2013.01); *C22C 38/002* (2013.01); *C22C 38/004* (2013.01); *C22C 38/005* (2013.01); *C22C 38/02* (2013.01); *C22C 38/04* (2013.01); *C22C 38/06* (2013.01); *C22C 38/18* (2013.01); *C22C 38/20* (2013.01); *C22C 38/22* (2013.01); *C22C 38/24* (2013.01); *C22C 38/26* (2013.01); *C22C 38/28* (2013.01); *C22C 38/30* (2013.01); *C22C 38/32* (2013.01); *C22C 38/40* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C21D 2211/005* (2013.01); *C21D 2211/008* (2013.01)

(56) References Cited

FOREIGN PATENT DOCUMENTS

| | | | |
|---|---|---|---|
| CN | 102839328 | | 12/2012 |
| EP | 0273279 | A2 | 7/1988 |
| EP | 1477574 | A2 | 11/2004 |
| JP | 5723024 | | 2/1982 |
| JP | 6311618 | A | 1/1988 |
| JP | 63169333 | A | 7/1988 |
| JP | 09111354 | | 4/1997 |
| JP | 1046293 | | 2/1998 |
| JP | H10324956 | A | 12/1998 |
| JP | 2001003143 | | 1/2001 |
| JP | 2003073783 | A | 3/2003 |
| JP | 3584881 | | 11/2004 |
| JP | 2006328525 | A | 12/2006 |
| JP | 2007119847 | A | 5/2007 |
| JP | 2010001504 | | 1/2010 |
| JP | 2013227659 | | 11/2013 |
| KR | 20110072698 | A | 6/2011 |

OTHER PUBLICATIONS

International Search Report and Written Opinion for International Application No. PCT/JP2015/000240, dated Apr. 21, 2015, 6 pages.
Supplementary European Search Report for Application No. EP 15740788.3, dated Jan. 31, 2017, 6 pages.
Korean Grant of Patent for Korean Application No. 10-2016-7022843, dated Dec. 28, 2017, including English translation, 3 pages.
Chinese Office Action for Chinese Application No. 201580005646.1, dated Oct. 20, 2017 with Concise Statement of Explanation, 9 pages.

* cited by examiner

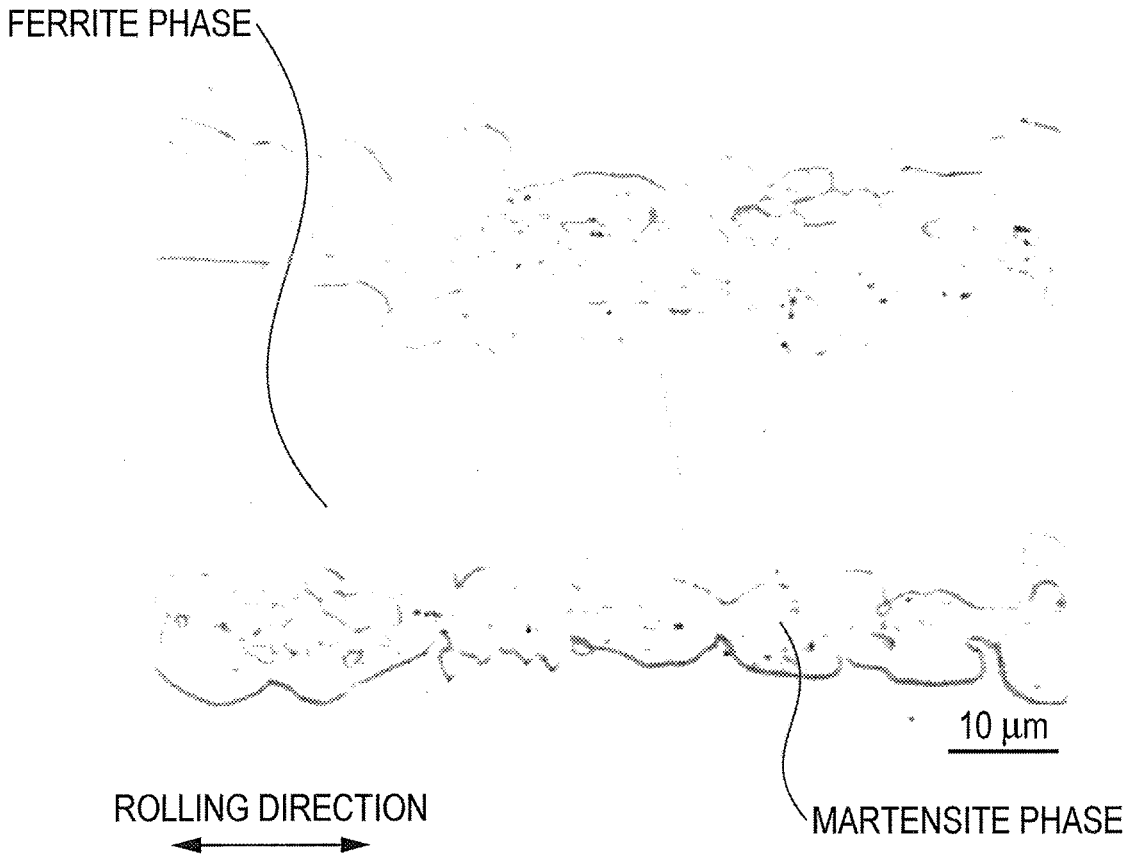
FERRITE PHASE
10 μm
ROLLING DIRECTION
MARTENSITE PHASE

MATERIAL FOR COLD-ROLLED STAINLESS STEEL SHEET AND PRODUCTION METHOD THEREFOR

CROSS-REFERENCE TO RELATED APPLICATIONS

This is the U.S. National Phase application of PCT International Application No. PCT/JP2015/000240, filed Jan. 20, 2015, and claims priority to Japanese Patent Application No. 2014-011306, filed Jan. 24, 2014 and Japanese Patent Application No. 2014-228503, filed Nov. 11, 2014, the disclosures of each of these applications being incorporated herein by reference in their entireties for all purposes.

FIELD OF THE INVENTION

The present invention relates to a material for a cold-rolled stainless steel sheet suitable for producing a cold-rolled stainless steel sheet having excellent formability, and to a production method therefor.

BACKGROUND OF THE INVENTION

Ferritic stainless steel (steel sheet), which is inexpensive and highly corrosion resistant, are used in a wide variety of applications including building material, transportation equipment, home electric appliances, kitchen instruments, automobile parts, etc., and the range of applications has seen further expansion in recent years. To be suitable for these applications, ferritic stainless steel is required to have not only corrosion resistance but also sufficient formability allowing the steel to be worked into desired shapes (in other words, the elongation needs to be large (hereinafter having sufficiently high elongation may be referred to as having ductility) and the average Lankford value (hereinafter may be referred to as an "average r-value") needs to be excellent) and excellent ridging resistance. Having excellent surface properties is also required if the applications require aesthetically appealing surfaces.

In this respect, Patent Literature 1 discloses a ferritic stainless steel having excellent formability and ridging resistance, the ferritic stainless steel containing, in terms of % by mass, C: 0.02% to 0.06%, Si: 1.0% or less, Mn: 1.0% or less, P: 0.05% or less, S: 0.01% or less, Al: 0.005% or less, Ti: 0.005% or less, Cr: 11% to 30%, and Ni: 0.7% or less, and satisfying $0.06 \leq (C+N) \leq 0.12$, $1 \leq N/C$, and $1.5\times10^{-3} \leq (V\times N) \leq 1.5\times10^{-2}$ (C, N, and V respectively represent the contents of the respective elements in terms of % by mass). According to Patent Literature 1, however, box annealing (for example, performing annealing at 860° C. for 8 hours) must be performed after hot rolling. This box annealing process requires about a week to finish if heating and cooling steps are also counted, and thus the productivity is low.

Patent Literature 2 discloses a ferritic stainless steel having excellent workability and surface properties, obtained by hot rolling a steel containing, in terms of % by mass, C: 0.01% to 0.10%, Si: 0.05% to 0.50%, Mn: 0.05% to 1.00%, Ni: 0.01% to 0.50%, Cr: 10% to 20%, Mo: 0.005% to 0.50%, Cu: 0.01% to 0.50%, V: 0.001% to 0.50%, Ti: 0.001% to 0.50%, Al: 0.01% to 0.20%, Nb: 0.001% to 0.50%, N: 0.005% to 0.050%, and B: 0.00010% to 0.00500%, annealing the resulting hot-rolled sheet in a box furnace or a continuous furnace of an annealing and pickling line (AP line) in a ferrite single-phase temperature region, and performing cold rolling and cold-rolled-sheet annealing. However, if a box furnace is used (box annealing), there is a problem of low productivity as with Patent Literature 1 described above. Although Patent Literature 2 makes no mention about elongation, annealing a hot-rolled sheet in a continuous annealing furnace in a ferrite single-phase temperature region results in insufficient recrystallization due to low annealing temperature, and the elongation is decreased compared to when box annealing is performed in a ferrite single-phase temperature region. Moreover, in general, when ferritic stainless steel such as one described in Patent Literature 2 is casted or hot-rolled, crystal grain groups (colonies) that have similar crystal orientations are formed and a problem of ridging arises after forming.

CITATION LIST

Patent Literature

PTL 1: Japanese Patent No, 3584881 (Re-publication of PCT International Publication No, WO00/60134)

PTL 2: Japanese Patent No. 3581801 (Japanese Unexamined Patent Application Publication No. 2001-3134)

SUMMARY OF THE INVENTION

An object of the present invention is to address the issues described above and to provide a material for cold rolling suitable for a cold-rolled ferritic stainless steel sheet that has sufficient corrosion resistance and ridging resistance as well as excellent formability and surface properties, and a method for producing the material.

For the purposes of the present invention, sufficient corrosion resistance means that when a steel sheet, whose end surface portions have been sealed after surfaces thereof were polish-finished with #600 emery paper, is subjected to 8 cycles of a salt spray cycle test (each cycle including salt spray (35° C., 5% NaCl, spraying: 2 hours)→drying (60° C., relative humidity: 40%, 4 hours)→wetting (50° C., relative humidity ≥95%, 2 hours)) prescribed in JIS H 8502, the rust area fraction (=rust area/total steel sheet area×100 [%]) in the steel sheet surface is 25% or less.

Excellent formability means that a test specimen taken in a direction perpendicular to the rolling direction exhibits that an elongation after fracture is 25% or more in a tensile test conducted according to JIS Z 2241 and that the average r-value calculated from formula (1) below under 15% strain in a tensile test prescribed in JIS Z 2241 is 0.70 or more:

$$\text{Average } r\text{-value} = (r_L + 2\times r_D + r_C)/4 \quad (1)$$

where $r_L$ is the r-value observed in a tensile test conducted in a direction parallel to the rolling direction, $r_D$ is the r-value observed in a tensile test conducted in a direction 45° with respect to the rolling direction, and $r_C$ is the r-value observed in a tensile test conducted in a direction 90° with respect to the rolling direction.

Good ridging resistance means that when a test specimen is prepared by polishing one side of a JIS No. 5 tensile test specimen, which has been sampled according to JIS Z 2201, with #600 emery paper and giving 20% pre-strain by uniaxial stretching and the surfaces of this test specimen are analyzed in accordance with JIS B 0601-2001 to measure the waviness at the center of the gauged portion of the test specimen, the maximum waviness (ridging height) is 2.5 μm or less.

Studies have been made to address the issues described above and it has been found that a cold-rolled stainless steel sheet that has sufficient corrosion resistance, formability, and ridging resistance is obtained after common cold rolling and cold-rolled-sheet annealing steps by using, as a material for cold rolling, a steel sheet that has a microstructure that contains, in terms of area fraction, 10% to 60% of a martensite phase having a Vickers hardness of HV500 or less. It has also been found that this cold-rolled stainless steel sheet has excellent surface properties.

The present invention has been made based on the above-described findings and includes:

[1] A material for a cold-rolled stainless steel sheet, the material comprising, in terms of % by mass, C: 0.007% to 0.05%, Si: 0.02% to 0.50%, Mn: 0.05% to 1.0%, P: 0.04% or less, S: 0.01% or less, Cr: 15.5% to 18.0%, Al: 0.001% to 0.10%, N: 0.01% to 0.06%, and the balance being Fe and unavoidable impurities, wherein the material has a microstructure that includes 10% to 60% of a martensite phase in terms of area fraction, with the remainder being a ferrite phase, and the martensite phase has a hardness of HV500 or less.

[2] A material for a cold-rolled stainless steel sheet, the material comprising, in terms of % by mass, C: 0.01% to 0.05%, Si: 0.02% to 0.50%, Mn: 0.2% to 1.0%, P: 0.04% or less, S: 0.01% or less, Cr: 16.0% to 18.0%, Al: 0.001% to 0.10%, N: 0.01% to 0.06%, and the balance being Fe and unavoidable impurities, wherein the material has a microstructure that includes 10% to 60% of a martensite phase in terms of area fraction, with the remainder being a ferrite phase, and the martensite phase has a hardness of HV500 or less.

[3] The material for a cold-rolled stainless steel sheet according to [1] or [2] above, wherein the material comprises, in terms of % by mass, C: 0.035% or less, Si: 0.25% or more and less than 0.40%, and Mn: 0.35% or less.

[4] The material for a cold-rolled stainless steel sheet according to [1] or [2] above, wherein the material comprises, in terms of % by mass, Si: less than 0.25% or Mn: more than 0.35%.

[5] The material for a cold-rolled stainless steel sheet according to any one of [1] to [4] above, the material further comprising, in terms of % by mass, at least one element selected from Cu: 0.1% to 1.0%, Ni: 0.1% to 1.0%, No: 0.1% to 0.5%, and Co: 0.01% to 0.2%.

[6] The material for a cold-roiled stainless steel sheet according to any one of [1] to [5] above, the material further comprising, in terms of % by mass, at least one element selected from V: 0.01% to 0.25%, Ti: 0.001% to 0.10%, Nb: 0.001% to 0.10%, Mg: 0.0002% to 0.0050%, B: 0.0002% to 0.0050%, REM: 0.01% to 0.10%, and Ca: 0.0002% to 0.0020%.

[7] A method for producing a material for a cold-rolled stainless steel sheet, the method comprising hot-rolling a steel slab having the composition according to any one of [1] to [6] above; and annealing the resulting hot-rolled sheet by holding the resulting hot-roiled sheet at a temperature in the range of 880° C. to 1050° C. for 5 seconds to 15 minutes and cooling the resulting sheet at a cooling rate of 10° C./sec or less in a temperature region of 350° C. to 150° C.

Throughout this specification, % indicating the content of a steel component means % by mass.

When the material for stainless steel cold rolling according to the present invention is used, a cold-rolled stainless steel sheet that has sufficient corrosion resistance and ridging resistance as well as excellent formability and that has excellent surface properties without seam defects caused by hot-rolled-sheet annealing can be obtained. This provides a notable industrial advantage.

BRIEF DESCRIPTION OF DRAWINGS

FIG. 1 is a diagram (optical microscope photograph) showing metallographic features of a ferrite phase and a martensite phase.

DETAILED DESCRIPTION OF EMBODIMENTS OF THE INVENTION

Embodiments of the present invention will now be described in detail.

The material for a cold-rolled stainless steel sheet according to an embodiment of the present invention contains, in terms of % by mass, C: 0.007% to 0.05%, Si: 0.02% to 0.50%, Mn: 0.05% to 1.0%, P: 0.04% or less, S: 0.01% or less, Cr: 15.5% to 18.0%, Al: 0.001% to 0.10%, N: 0.01% to 0.06%, and the balance being Fe and unavoidable impurities, and has a microstructure that includes, in terms of area fraction, 10% to 60% of a martensite phase, with the remainder being a ferrite phase. Moreover, the martensite phase has a hardness of HV500 or less.

The material for a cold-rolled stainless steel sheet according to the present invention can be produced by hot-rolling a steel to prepare a hot-rolled sheet, annealing the hot-rolled sheet (hot-rolled-sheet annealing) by holding the hot-rolled sheet at a temperature of 880° C. to 1050° C., which is a ferrite-austenite dual-phase temperature region, for 5 seconds to 15 minutes, and then cooling the resulting sheet at a cooling rate of 10° C./sec or less in a temperature region of 350° C. to 150° C.

When the material for stainless steel cold rolling according to the present invention is cold-rolled and then annealed by common processes, a cold-rolled stainless steel sheet that has sufficient corrosion resistance and formability and excellent ridging resistance and surface properties can be obtained.

First, the technical features of the present invention are described in detail.

The inventors have focused on a technique of achieving desired workability by annealing a hot-rolled sheet for a short period of time using a continuous annealing furnace, which is a furnace with high productivity, instead of annealing a hot-rolled sheet for a long period of time such as in box annealing (batch annealing). The problem of the related art that uses continuous annealing furnaces is that since annealing is performed in a ferrite single-phase temperature region, sufficient recrystallization does not occur, sufficient elongation is not achieved, and ridging resistance is poor due to colonies remaining after cold-rolled-sheet annealing. The inventors then have come up with an idea of annealing a hot-rolled sheet in a ferrite-austenite dual-phase region, then cooling the resulting sheet at a particular cooling rate so as to induce martensite having a particular area fraction and particular hardness to form, and then performing cold rolling and cold-rolled-sheet annealing by common procedures so that a ferrite phase microstructure is again obtained at the end.

That is, when a hot-rolled sheet is annealed in a ferrite-austenite dual-phase temperature region higher than the ferrite single-phase temperature region, recrystallization of a ferrite phase is promoted. As a result, ferrite crystal grains to which working strain has been introduced by hot rolling do not remain after cold-rolled-sheet annealing, and elongation after cold-rolled-sheet annealing is improved. When an austenite phase is formed from a ferrite phase by hot-rolled-sheet annealing, the austenite phase is formed by having crystal orientations different from that of the ferrite phase before annealing. Thus colonies of the ferrite phase are effectively destroyed and the average r-value and ridging resistance are improved.

However, further studies have revealed that when a hot-rolled sheet made of a steel having a conventional composition is annealed in the ferrite-austenite dual-phase region, line-like defects (hereinafter referred to as seam defects) occur in the rolling direction after the cold-rolled-sheet annealing, and the surface properties are significantly deteriorated, which poses a new problem.

In order to achieve both formability and surface properties, the inventors have investigated the cause of occurrence of seam defects resulting from hot-rolled-sheet annealing in the ferrite-austenite dual-phase region.

It has been found that seam defects are caused by a significantly hard martensite phase that exists in a surface layer portion of a steel sheet after hot-rolled-sheet annealing. In other words, when a significantly hard martensite phase is present in a surface layer portion of a steel sheet after the hot-rolled-sheet annealing, strains concentrate at the interfaces between the significantly hard martensite phase and the ferrite phase during the subsequent cold rolling process and cause microcracks that will form seam defects after the cold-rolled-sheet annealing. The martensite phase is formed as a result of transformation of an austenite phase, which has been formed in the hot-rolled-sheet annealing in the ferrite-austenite dual-phase region, as cooling proceeds. The hardness of the martensite grains in the microstructure has been studied. It has been found that while most part of the martensite phase has a Vickers hardness of about HV300 to HV400, some part of the martensite phase has shown a significantly high hardness with HV exceeding 500, and that microcracks that occur in cold rolling occur at the interfaces between the ferrite phase and the significantly hard martensite phase with HV exceeding 500.

The inventors have come up with an idea of controlling the cooling process after performing annealing in a ferrite-austenite dual-phase region for a short time so that the cooling rate within the temperature region of 350° C. to 150° C. is 10° C./sec or less. That is, in the steel according to the present invention, the martensite phase is generated by transformation of the austenite phase during cooling from the annealing temperature to room temperature. Decreasing the cooling rate extends the time taken for the steel sheet temperature to reach a temperature region spanning from the martensite transformation start temperature (hereinafter may be referred to as Ms temperature) to room temperature. As a result, the martensite phase generated as the temperature passes through the Ms temperature is self-tempered and the hardness of the martensite phase can be decreased to HV500 or less. This makes it possible to avoid occurrence of seam defects caused by a significantly hard martensite phase while material properties (r-value and ridging resistance) after cold-rolled-sheet-annealing are improved due to the presence of the martensite phase.

The above-described results of the investigations show that presence of a particular amount of a martensite phase in the microstructure and decreasing the hardness of the martensite phase are important. In an embodiment of the present invention, based on the above-described findings, the area fraction of the martensite phase is to be 10% to 60%. In the present invention, the austenite phase is formed by hot-rolled-sheet annealing so that colonies of the ferrite phase in the hot-rolled sheet disappear. Due to the presence of the martensite phase after hot-rolled-sheet annealing, ridging resistance is improved and a γ-fiber texture, that increases r-value, develops sufficiently. These effects brought by the martensite phase are also enhanced when primary austenite grain boundaries and block or lath boundaries of the martensite phase function as recrystallization sites for the ferrite phase during finish annealing so that recrystallization is promoted during cold-rolled-sheet annealing, as described above. These effects are obtained when the area fraction of the martensite phase after hot-rolled-sheet annealing is 10% or more. However, when the area fraction of the martensite phase exceeds 60%, the hot-rolled and annealed sheet becomes hard and edge cracking and sheet shape defects occur in the cold rolling step, which is not preferable from the production viewpoint. Thus, the area fraction of the martensite phase is set to 10% to 60%. The area fraction is preferably in the range of 10% to 50% and more preferably in the range of 10% to 40%.

According to the steel composition range of an embodiment of the steel of the present invention, most part of the austenite phase generated at a hot-rolled-sheet annealing temperature transforms into a martensite phase; thus, the area fraction of the austenite phase generated at the hot-rolled-sheet annealing temperature is substantially equal to the area fraction of the martensite phase after the hot-rolled-sheet annealing. The area fraction of the austenite phase is dependent on the composition (in particular, C, N, Si, Mn, Cr, Ni, and Cu) and the hot-rolled-sheet annealing temperature. Therefore, the desired martensite phase area fraction can be obtained by controlling the composition and the hot-rolled-sheet annealing temperature.

The area fraction of the martensite phase can be measured by the method described in Examples below.

In an embodiment of the present invention, the hardness of the martensite phase is to be HV500 or less. In order to obtain good ridging resistance and a high average r-value, a particular amount of the martensite phase must be present in the hot-rolled and annealed sheet, as discussed above. However, when a significantly hard martensite phase exceeding HV500 is present, microcracks are generated from the interfaces between the hard martensite phase and the ferrite phase during cold rolling due to the difference in hardness. The microcracks appear as seam defects along the rolling direction after cold-rolled-sheet annealing and deteriorate the aesthetic appeal of the steel sheet surface. Thus, the hardness of the martensite phase of the hot-rolled and annealed sheet must be HV500 or less, is preferably HV475 or less, and is more preferably HV450 or less. The hardness of the martensite phase can be controlled by adjusting the cooling rate after hot-rolled-sheet annealing.

Next, the composition of the ferritic stainless steel according to an embodiment of the present invention is described. In the description below, means % by mass unless otherwise noted.

C. 0.007% to 0.05%

Carbon (C) has an effect of expanding the dual-phase temperature region, which is a region in which the ferrite phase and the austenite phase are formed, during hot-rolled sheet annealing by promoting generation of the austenite phase. In order to obtain this effect, the C content needs to be 0.007% or more. At a C content exceeding 0.05%, however, the steel sheet becomes hard and ductility is deteriorated. Moreover, a significantly hard martensite phase is formed after hot-rolled-sheet annealing even in the present invention with resulting in the occurrence of seam defects after cold-rolled-sheet annealing, which is not preferable. Thus, the C content is to be in the range of 0.007% to 0.05%. The lower limit is preferably 0.01% and more preferably 0.015%. The upper limit is preferably 0.03% and more preferably 0.025%.

Si: 0.02% to 0.50%

Silicon (Si) is an element that acts as a deoxidizer in melting the steel. In order to obtain this effect, the Si content needs to be 0.02% or more. At a Si content exceeding 0.50%, however, the steel sheet becomes hard and the rolling load during hot rolling is increased. Moreover, the ductility after cold-rolled-sheet annealing is deteriorated. Thus, the Si content is to be in the range of 0.02% to 0.50%. The Si content is preferably in the range of 0.10% to 0.35% and more preferably in the range of 0.25% to 0.30%.

Mn: 0.05% to 1.0%

As with carbon (C), manganese (Mn) has an effect of expanding the dual-phase temperature region, which is a region in which the ferrite phase and the austenite phase are formed, during hot-rolled-sheet annealing by promoting formation of the austenite phase. In order to obtain this effect, the Mn content needs to be 0.05% or more. At a Mn content exceeding 1.0%, however, the amount of MnS formed increases and corrosion resistance is deteriorated. Thus, the Mn content is to be in the range of 0.05% to 1.0%. The lower limit is preferably 0.1% and more preferably 0.2%. The upper limit is preferably 0.8% and more preferably 0.3%.

P: 0.04% or less

Phosphorus (P) is an element that promotes intergranular fracture by intergranular segregation and thus the P content is preferably as low as possible. The upper limit is to be 0.04%. The P content is preferably 0.03% or less.

S: 0.01% or less

Sulfur (S) is an element that deteriorates ductility, corrosion resistance, etc., by forming sulfide-based inclusions such as MnS. In particular, at an S content exceeding 0.01%, these adverse effects become notable. The S content is thus preferably as low as possible and the upper limit of the S content is set to 0.01% in the present invention. The S content is preferably 0.007% or less and more preferably 0.005% or less.

Cr: 15.5% to 18.0%

Chromium (Cr) is an element that has an effect of improving corrosion resistance by forming a passivation film on a steel sheet surface. In order to obtain this effect, the Cr content needs to be 15.5% or more. At a Cr content exceeding 18.0%, however, formation of the austenite phase is insufficient during hot-rolled-sheet annealing and desired material properties are not obtained. Thus, the Cr content is to be in the range of 15.5% to 18.0%. The Cr content is preferably in the range of 16.0% to 18.0% and more preferably in the range of 16.0% to 17.25%.

Al: 0.001% to 0.10%

As with Si, aluminum (Al) is an element that acts as a deoxidizer. In order to obtain this effect, the Al content needs to be 0.001% or more. At an Al content exceeding 0.10%, however, the amount of the Al-based inclusions such as $Al_2O_3$ increases, and the surface properties tend to be deteriorated. Thus, the Al content is to be in the range of 0.001% to 0.10%, preferably in the range of 0.001% to 0.07%, more preferably in the range of 0.001% to 0.05%, and yet more preferably in the range of 0.001% to 0.03%.

N: 0.01% to 0.06%

As with C and Mn, nitrogen (N) has an effect of expanding the dual-phase temperature region, which is a region in which the ferrite phase and the austenite phase are formed, during hot-rolled sheet annealing by promoting formation of the austenite phase. In order to obtain this effect, the N content needs to be 0.01% or more. At an N content exceeding 0.06%, however, ductility is significantly deteriorated, and corrosion resistance is deteriorated due to accelerated precipitation of Cr nitrides. Thus, the N content is to be in the range of 0.01% to 0.06%, preferably in the range of 0.01% to 0.05%, and more preferably in the range of 0.02% to 0.04%.

It has also been found that the elongation after fracture can be adjusted to 27% or more when the C content is 0.035% or less, the Si content is 0.25% or more and less than 0.40%, and the Mn content is 0.35% or less. When the amount of Si, which is a ferrite-stabilizing element, and the amounts of C and Mn, which are austenite-stabilizing elements, are adjusted within these preferable ranges, the lower limit temperature at which the austenite phase is formed can be shifted toward the high temperature side. With this method, a ferrite single-phase microstructure with sufficiently grown grains can be obtained even by cold-rolled-sheet annealing conducted in a ferrite-single-phase temperature region. As a result, the elongation after fracture can be adjusted to 27% or more.

C: 0.035% or less, Si: 0.25% or more and less than 0.40%, Mn: 0.35% or less

As described above, carbon (C) expands the dual-phase temperature region, which is a region in which the ferrite phase and the austenite phase are formed, during hot-rolled sheet annealing by promoting formation of the austenite phase. In order to shift the lower limit temperature at which the austenite phase is formed, toward the high temperature side so that the elongation after fracture becomes 27% or more, the C content is to be 0.035% or less. The C content is preferably 0.030% or less and more preferably 0.025% or less. Silicon (Si) is an element that increases the lower limit temperature at which the austenite phase is formed during hot-rolled-sheet annealing by promoting formation of the ferrite phase. In order to obtain this effect, the Si content needs to be 0.25% or more. At a Si content of 0.407, or more, however, the steel sheet becomes hard, the ductility after cold-rolled-sheet annealing is deteriorated, and an elongation after fracture of 27% or more is no longer obtained. Thus, if the elongation after fracture is to be 27% or more, the Si content is adjusted to 0.25% or more and less than 0.40% in addition to adjusting the C content to 0.035% or less. Preferably, the Si content is in the range of 0.25% to 0.35% and more preferably in the range of 0.25% to 0.30%.

As with C, Mn promotes formation of the austenite phase. At a Mn content exceeding 0.35%, the lower limit temperature for generating the austenite phase does not rise and an elongation after fracture of 27% or more is no longer obtained. Thus, if the elongation after fracture is to be 27% or more, the Mn content is adjusted to 0.35% or less in addition to adjusting the C content to 0.035%, or less and the Si content to 0.25% or more and less than 0.40%. The Mn content is preferably in the range of 0.10% to 0.30% and more preferably in the range of 0.15% to 0.25%.

It has also been found that when the Si content is less than 0.25% or the Mn content is more than 0.35%, $|\Delta r|$ is decreased, as described below. By adjusting the amount of Si, which is a ferrite-stabilizing element, and the amount of Mn, which is an austenite-stabilizing element, to be in these preferable ranges, the microstructure during cold-rolled-sheet annealing comes to have an austenite-ferrite dual-phase in which a small amount, namely, few percent, of the austenite phase is dispersed. When annealing is conducted under such conditions, the dispersed austenite phase serves as obstructions, ferrite grains undergo similar grain growth in all directions, and thus anisotropy of microstructure is relaxed, resulting in a decrease in $|\Delta r|$.

Si: less than 0.25% or Mn: more than 0.35%

When the Si content is adjusted to less than 0.25% or the Mn content is adjusted to more than 0.35% and when cold-rolled-sheet annealing is performed in an austenite-ferrite dual-phase temperature region while an appropriate amount of the austenite phase is present, |Δr| of the resulting cold-rolled and annealed sheet can be adjusted to 0.2 or less. It has also been found that, under such conditions, the average r-value and Δr are little affected by the cold rolling reduction. According to a conventional composition and a conventional production method, since the average r-value and Δr after cold-rolled-sheet annealing depend on the cold rolling reduction, a particular level of cold rolling reduction has been needed in order to obtain desired material properties. Thus, it has been necessary to prepare hot-rolled steel sheets having various finishing sheet thicknesses in order to produce cold rolled steel sheets of particular thicknesses. In contrast, the material for stainless steel cold rolling according to an embodiment of the present invention containing Si: less than 0.25% or Mn: more than 0.35%, the cold rolling reduction has little effect on the material properties after cold-rolled-sheet annealing. Thus, there is no need to prepare a variety of hot-rolled sheets with different thicknesses and the productivity of the hot rolling step can be notably improved.

The balance is Fe and unavoidable impurities.

Although the effects of the present invention are obtained by the composition described above, the following elements may be contained to improve manufacturability or material properties.

At least one element selected from Cu: 0.1% to 1.0%, Ni: 0.1% to 1.0%, Mo: 0.1% to 0.5%, and Co: 0.01% to 0.2%

Copper (Cu) and nickel (Ni) are both an element that improves corrosion resistance and are preferably contained if particularly high corrosion resistance is required. Moreover, Cu and Ni have an effect of expanding the dual-phase temperature region, which is a region in which the ferrite phase and the austenite phase are formed, during hot-rolled-sheet annealing by promoting formation of the austenite phase. These effects are notable when each element is contained in an amount of 0.1% or more. At a Cu content exceeding 1.0%, however, hot workability may be deteriorated, which is not preferable. If Cu is to be contained, the Cu content is to be 0.1% to 1.0%, is preferably in the range of 0.2% to 0.8%, and is more preferably in the range of 0.3% to 0.5%. A Ni content exceeding 1.0% is not preferable since workability is deteriorated. Thus, when Ni is to be contained, the Ni content is to be 0.1% to 1.0%, preferably in the range of 0.1% to 0.6%, and more preferably in the range of 0.1% to 0.3%.

Molybdenum (Mo) is an element that improves corrosion resistance and it is effective to use Mo when particularly high corrosion resistance is required. This effect becomes notable at a Mo content of 0.1% or more. However, a Mo content exceeding 0.5% is not preferable since formation of the austenite phase during hot-rolled-sheet annealing is insufficient and desired material properties are not obtained. Thus, if Mo is to be contained, the Mo content is to be 0.1% to 0.5% and preferably in the range of 0.1% to 0.3%.

Cobalt (Co) is an element that improves toughness. This effect is obtained at a Co content of 0.01% or more. At a Co content exceeding 0.2%, manufacturability is deteriorated. Thus, if Co is to be contained, the Co content is to be in the range of 0.01% to 0.2%.

At least one element selected from V: 0.01% to 0.25%, Ti: 0.001% to 0.10%, Nb: 0.001% to 0.10%, Mg: 0.0002% to 0.0050%, B: 0.0002% to 0.0050%, REM: 0.01% to 0.10%, and Ca: 0.0002% to 0.0020%

V: 0.01% to 0.25%

Vanadium (V) forms compounds with C and N to decrease the amounts of dissolved C and N. As a result, the average r-value is improved. Vanadium also improves surface properties by suppressing occurrence of seam defects attributable to hot rolling and annealing by controlling the carbonitrides precipitation behavior in the hot-rolled sheet. In order to obtain these effects, the V content needs to be 0.01% or more. At a V content exceeding 0.25%, however, workability is deteriorated and the manufacturing cost rises. Thus, when V is to be contained, the V content is to be in the range of 0.01% to 0.25%. The V content is preferably in the range of 0.03% to 0.20% and more preferably in the range of 0.05% to 0.15%.

Ti: 0.001% to 0.10% and Nb: 0.001% to 0.10%

As with V, titanium (Ti) and niobium (Nb) are each an element that has high affinity to C and N and each have an effect of improving workability after finish annealing by decreasing the amount of dissolved C and N in the base metal through precipitation as carbides or nitrides during hot rolling. In order to obtain these effects, 0.001% or more of Ti and/or 0.001% or more of Nb must be contained. At a Ti content exceeding 0.10% or an Nb content exceeding 0.10%, TiN and NbC precipitate excessively and good surface properties can no longer be obtained. Thus, if Ti is to be contained, the Ti content is to be in the range of 0.001% to 0.10%; if Nb is to be contained, the Nb content is to be in the range of 0.001% to 0.10%. The Ti content is preferably in the range of 0.001% to 0.015% and more preferably in the range of 0.003% to 0.010%. The Nb content is preferably in the range of 0.001% to 0.030% and more preferably in the range of 0.005% to 0.020%.

Mg: 0.0002% to 0.0050%

Magnesium (Mg) is an element that has an effect of improving hot workability. In order to obtain this effect, the Mg content needs to be 0.0002% or more. At an Mg content exceeding 0.0050%, however, surface quality is deteriorated. Thus, if Mg is to be contained, the Mg content is to be in the range of 0.0002% to 0.0050%. The Mg content is preferably in the range of 0.0005% to 0.0035% and more preferably in the range of 0.0005% to 0.0020%.

B: 0.0002% to 0.0050%

Boron (B) is an element effective for preventing low-temperature secondary working embrittlement. In order to obtain this effect, the B content needs to be 0.0002% or more. At a B content exceeding 0.0050%, however, hot workability is deteriorated. Thus, if B is to be contained, the B content is to be in the range of 0.0002% to 0.0050%. The B content is preferably in the range of 0.0005% to 0.0035% and more preferably in the range of 0.0005% to 0.0020%.

REM: 0.01% to 0.10%

A rare earth metal (REM) is an element that improves oxidation resistance and particularly has an effect of improving corrosion resistance of weld zones by suppressing formation of oxide coatings in the weld zones. In order to obtain this effect, the REM content needs to be 0.01% or more. At a REM content exceeding 0.10%, however, manufacturability such as a pickling property during cold-roll annealing process is deteriorated. Moreover, since REM is an expensive element, excessive incorporation thereof is not preferable due to a high manufacturing cost. Thus, if REM is to be contained, the REM content is to be in the range of 0.01% to 0.10%.

Ca: 0.0002% to 0.0020%

Calcium (Ca) is a component effective for preventing nozzle clogging caused by crystallization of Ti-based inclusions that is likely to occur during continuous casting. In order to obtain this effect, the Ca content needs to be 0.0002% or more. At a Ca content exceeding 0.0020%, however, the corrosion resistance is deteriorated by the formation of CaS. Thus, if Ca is to be contained, the Ca content is to be in the range of 0.0002%, to 0.0020%. The Ca content is preferably in the range of 0.0005%, to 0.0015% and more preferably in the range of 0.0005% to 0.0010%.

A method for producing a material for stainless steel cold rolling according to an embodiment of the present invention will now be described.

The material for stainless steel cold rolling according to an embodiment of the present invention is obtained by hot-rolling a steel slab having the above-described composition and annealing the resulting hot-rolled sheet by holding the sheet at a temperature in the range of 880° C. to 1050° C. for 5 seconds to 15 minutes and cooling the resulting sheet at a cooling rate of 10° C./sec or less in the temperature region of 350° C. to 150° C.

The molten steel having the above-described composition is melted by a known method such as by using a converter, an electric furnace, or a vacuum melting furnace, and formed into a steel material (slab) by a continuous casting method or an ingoting-blooming method. The slab is heated at 1100° C. to 1250° C. for 1 to 24 hours or the slab as casted is directly hot-rolled without heating so as to prepare a hot-rolled sheet.

Next, the hot-rolled sheet is annealed at a ferrite-austenite dual-phase temperature in the range of 880° C. to 1050° C. for 5 seconds to 15 minutes.

Hot-Rolled-Sheet Annealing at 880° C. to 1050° C. for 5 Seconds to 15 Minutes

Hot-rolled-sheet annealing is a critical step for obtaining the microstructure of the present invention. When the hot-roiled-sheet annealing temperature is lower than 880° C., sufficient recrystallization does not occur and the effects of the present invention achieved by the dual-phase annealing are no longer obtained since annealing is conducted in the ferrite single-phase region. In contrast, when the temperature exceeds 1050° C., because dissolution of carbides is promoted, concentration of C in the austenite phase is promoted further, and as a result, a significantly and martensite phase is formed after hot-rolled-sheet annealing. Thus, desired surface properties are not obtained. If the annealing time is shorter than 5 seconds, formation of the austenite phase and recrystallization of the ferrite phase are not sufficient even when annealing is conducted at a specified temperature, and thus the desired formability is not obtained. If the annealing time is longer than 15 minutes, some of the carbides dissolve and C concentration in the austenite phase is promoted. Thus, due to the mechanism similar to that described above, desired surface properties are not obtained. Therefore, hot-rolled-sheet annealing is to be conducted at 880° C. to 1050° C. for 5 seconds to 15 minutes.

In particular, when the elongation, after fracture of the cold-rolled and annealed sheet is adjusted to 27% or more by adjusting the C content to 0.035% or less, the Si content to 0.25% or more and less than 0.40%, and the Mn content to 0.35% or less, a temperature in the range of 900° C. to 1050° C. is to be held for 5 seconds to 15 minutes. Preferably, a temperature in the range of 920° C. to 1020° C. is held for 15 seconds to 5 minutes. More preferably, a temperature in the range of 920° C. to 1000° C. is held for 30 seconds to 3 minutes.

When $|\Delta r|$ of the cold-rolled and annealed sheet is adjusted to 0.2 or less by controlling the Si content to less than 0.25% or the Mn content to more than 0.35%, a temperature in the range of 880° C. to 1000° C. is to be retained for 15 seconds to 15 minutes. Preferably, a temperature in the range of 900° C. to 960° C. is held for 15 seconds to 5 minutes.

Next, cooling in the range of 350° C. to 150° C. is performed at a cooling rate of 10° C./sec or less. Subsequently, if needed, at least one selected from a shot-blasting treatment, surface polishing, and pickling is performed.

Cooling in the Range of 350° C. to 150° C. is Performed at a Cooling Rate of 10° C./Sec or Less When hot-rolled-sheet annealing is performed at a temperature in the ferrite-austenite dual-phase region, C in the steel concentrates in the austenite phase. Thus, if the cooling process after the steel having the composition of the present invention is hot-rolled and annealed is not controlled, desired surface properties are not obtained since a significantly hard martensite phase exceeding HV500 is formed. Thus, in an embodiment of the present invention, in the cooling process after hot-rolled-sheet annealing, the cooling rate is controlled in the temperature region 350° C. or lower, which is a region in which a martensite phase is generated. By controlling the cooling rate, the martensite phase that has been formed becomes self-tempered before completion of the cooling process for hot-rolled-sheet annealing and thus the hardness is decreased to HV500 or less. In order to obtain this effect, the cooling rate in the temperature region of 350° C. to 150° C. is to be 10° C./sec or less. If the cooling rate exceeds 10° C./sec, self-tempering of the martensite phase during cooling is insufficient, and a sufficient softening effect is not obtained. Preferably, the cooling rate is 7° C./sec or less and more preferably 5° C./sec or less.

Preferable conditions for producing a cold-rolled stainless steel sheet by using the material for a cold-rolled stainless steel sheet according to the present invention will now be described.

The material for a cold-rolled stainless steel sheet of the present invention is cold rolled into a cold rolled sheet, and the cold rolled sheet is annealed and, if needed, pickled or surface-polished to obtain a product.

From the viewpoints of formability and shape correction, cold rolling is preferably conducted at a reduction of 50% or more. In the present invention, cold-rolling/annealing may be performed two or more times, and a stainless steel foil having a thickness of 200 μm or less may be formed by cold rolling.

The cold rolled sheet is preferably annealed at 800° C. to 950° C. to obtain good formability. In particular, when the elongation after fracture of the cold-rolled and annealed sheet is to be 27% or more by controlling the C content to 0.035% or less, the Si content to 0.25% or more and less than 0.40%, and the Mn content to 0.35% or less, a temperature of 850° C. to 900° C. is preferably held for 15 seconds to 3 minutes. If more gloss is required, bright annealing (BA annealing) may be performed.

In order to further improve surface properties after cold rolling and after working, grinding, polishing, or the like process may be performed.

Example 1

The present invention will now be described in detail through Examples.

Stainless steels having the compositions shown in Table 1 were each melted in a 50 kg small-scale vacuum melting furnace. The resulting steel ingot was heated at 1150° C. for 1 hour and hot rolled into a hot-rolled sheet having a thickness of 3.5 mm. Next, each hot-rolled sheet was subjected to hot-rolled-sheet annealing under conditions described in Table 2. The surface of the resulting annealed sheet was descaled by a shot blast treatment and pickling. Pickling involved immersing the sheet in a 20 mass % sulfuric acid solution at a temperature of 80° C. for 120 seconds and then immersing the sheet in a 15 mass % nitric acid-3 mass % hydrofluoric acid mixed solution at a temperature of 55° C. for 60 seconds. As a result, a hot-rolled and annealed sheet was obtained.

The resulting hot-rolled and annealed sheet was cold rolled to a thickness of 0.7 mm, and the resulting cold rolled sheet was annealed under conditions set forth in Table 2. Then the cold-rolled and annealed sheet was subjected to a descaling treatment that involved electrolytic pickling in a 18 mass % aqueous $Na_2SO_4$ solution having a solution temperature of 80° C. under a condition of 25 C/dm$^2$ and electrolytic pickling in a 10 mass % aqueous $HNO_3$ solution having a solution temperature of 50° C. under a condition of 30 C/dm$^2$. As a result, a cold-rolled and annealed sheet was obtained.

A test specimen for microstructural observation was taken from a center portion of the hot-rolled and annealed sheet in the width direction. A section taken from the test specimen in the rolling direction was mirror-polished and corroded (etched) with a hydrochloric-picric acid solution. The center portion in the thickness direction of the section was observed with an optical microscope at a magnification of 400, and photographs of ten view areas were taken. For each microstructure photograph, the martensite phase and ferrite phase were identified and separated based on metallographic features, the area fraction of the martensite phase was measured by using an image analyzer, and the average of ten view areas was assumed to be the area fraction of the martensite phase of that hot-roiled and annealed sheet. FIG. 1 is a photograph showing an example of identification. FIG. 1 is an optical microscope photograph of No. 4 in Table 2 taken at a magnification of 400. For the purposes of the present invention, crystal grains in which an internal structure unique to the martensite phase is observed within the grain are defined as the martensite phase. In measuring the area fraction, precipitates (carbides and nitrides) and inclusions were excluded.

The hardness was measured from a test specimen for microstructural observation taken from a center portion of the hot-rolled and annealed sheet in the width direction. A section of the test specimen was taken in the rolling direction, mirror-polished, and corroded (etched) with a hydrochloric-picric acid solution. Then the martensite phase and ferrite phase were identified with an optical microscope equipped in a micro Vickers hardness meter based on the metallographic features. For the martensite phase, a total of 100 crystal grains were measured for each sample with a 1 g load and for a loading time of 5 seconds. The maximum hardness of each specimen is shown in Table 2.

The cold-rolled and annealed sheets obtained were evaluated as follows.

(1) Surface Quality Evaluation

After cold-roll annealing, the number of seam defects having a length of 5 mm or more present per square meter of the steel sheet was counted. Samples in which the number of seam defects on the surface of the cold-rolled and annealed sheet was 5 or less per square meter of the steel sheet were rated pass, and samples which had more than 5 seam defects were rated fail.

(2) Evaluation of Ductility

JIS No, 13B tensile test specimens were taken in the rolling direction and in a direction perpendicular to the rolling direction from the cold-rolled, pickled, and annealed sheet. A tensile test was conducted on the test specimens according to JIS Z 2241 to measure the elongation after fracture. Samples with an elongation after fracture of 27% or more were considered to have particularly excellent properties and were rated pass (indicated by double circles), samples with an elongation after fracture of less than 27% but 25% or more were rated pass (indicated by circles), and samples with an elongation after fracture of less than 25% were rated fail (indicated by cross marks).

(3) Evaluation of Average r-Value and $|\Delta r|$

JIS No. 13B tensile test specimens were taken in a direction parallel (L direction) to the rolling direction, a direction 45° (D direction) with respect to the rolling direction, and a direction 90° (C direction) with respect to the rolling direction. A tensile test was conducted in accordance with JIS Z 2241 up to 15% strain and interrupted. The r-values of the respective directions were measured and the average r-value ($=(r_L+2r_D+r_C)/4$) and the absolute value ($|\Delta r|$) of the r-value in-plane anisotropy ($\Delta r=(r_L-2r_D+r_C)/2$) were calculated. Here, $r_L$, $r_D$, and $r_C$ are respectively r-values in the L direction, the D direction, and the C direction. Samples with an average r-value of 0.70 or more were rated pass (indicated by circles) and samples with an average r-value less than 0.70 were rated fail (indicated by cross marks). Samples with $|\Delta r|$ of 0.20 or less are indicated by circles and samples with $|\Delta r|$ exceeding 0.20 are indicated by triangles. A $|\Delta r|$ of 0.20 or less is a particularly excellent property.

(4) Evaluation of Ridging Resistance

A JIS No. 5 tensile test specimen was taken from the obtained cold-rolled and annealed, sheet in a direction parallel, to the rolling direction. One side of the test specimen was polished with #600 emery paper, the test specimen was given a 20% pre-strain by uniaxial stretching, and the maximum waviness (ridging height) observed at the center of the gauged portion of the tensile test specimen was measured in accordance with JIS B 0601-2001. Samples with a maximum waviness (ridging height) of 2.5 μm or less were rated pass (indicated by circles) and samples with a maximum undulation exceeding 2.5 μm were rated fail (indicated by cross marks).

(5) Evaluation of Corrosion Resistance.

A 60 mm×100 mm test specimen was sampled from the cold-rolled, pickled, and annealed sheet, the surface thereof was polish-finished with #600 emery paper, and end surfaces were sealed to prepare a test piece to be used in a salt spray cycle test prescribed in JIS H 8502. The salt spray cycle test was performed 8 cycles, each cycle including salt spray (5% by mass NaCl, 35° C., spraying: 2 hours)→drying (60° C., 4 hours, relative humidity: 40%)→wetting (50° C., 2 hours, relative humidity ≥95%).

The surface of the test piece after 8 cycles of the salt spray cycle test was photographed, the rust area of the test piece surface was measured by image processing, and the rust area fraction ((rust area in test piece/total area of test piece)×100 [%]) was calculated as a ratio with respect to the total area of the test piece. Samples with a rust area fraction of 10% or less were rated pass with particularly excellent corrosion resistance (indicated by double circles), samples with a rust area fraction of more than 10% but not more than 25% were rated pass (indicated by circles), and samples with a rust area fraction more than 25% were rated fail (indicated by cross marks).

The evaluation results and the hot-rolled-sheet annealing conditions are shown in Table 2

TABLE 1 mass %

| Steel Code | C | Si | Mn | P | S | Cr | Al | N | Ni | Other | Note |
|---|---|---|---|---|---|---|---|---|---|---|---|
| A | 0.03 | 0.15 | 0.7 | 0.02 | 0.002 | 16.3 | 0.002 | 0.03 | 0.1 | | Example |
| B | 0.02 | 0.41 | 0.5 | 0.03 | 0.003 | 17.4 | 0.025 | 0.04 | 0.3 | V: 0.20 | Example |
| C | 0.03 | 0.27 | 0.9 | 0.04 | 0.008 | 16.3 | 0.004 | 0.03 | 0.1 | V: 0.14 | Example |
| D | 0.04 | 0.23 | 0.7 | 0.02 | 0.004 | 17.6 | 0.078 | 0.03 | — | Ti: 0.014, Nb: 0.021 | Example |
| E | 0.03 | 0.35 | 0.5 | 0.02 | 0.003 | 16.2 | 0.003 | 0.03 | 0.2 | V: 0.13, Ti: 0.013, Nb: 0.0018 | Example |
| F | 0.02 | 0.17 | 0.5 | 0.02 | 0.009 | 16.7 | 0.028 | 0.04 | — | | Example |
| G | 0.03 | 0.19 | 0.8 | 0.02 | 0.003 | 16.4 | 0.011 | 0.06 | 0.2 | Cu: 0.4 | Example |
| H | 0.03 | 0.23 | 0.8 | 0.03 | 0.005 | 16.5 | 0.005 | 0.02 | 0.5 | V: 0.16 | Example |
| I | 0.02 | 0.25 | 0.9 | 0.03 | 0.004 | 16.7 | 0.007 | 0.03 | 0.1 | Mo: 0.4 | Example |
| J | 0.04 | 0.15 | 0.7 | 0.02 | 0.003 | 16.1 | 0.004 | 0.02 | 0.2 | Mg: 0.0013 | Example |
| K | 0.02 | 0.14 | 0.8 | 0.03 | 0.004 | 16.5 | 0.005 | 0.03 | — | V: 0.13, B: 0.0018 | Example |
| L | 0.04 | 0.26 | 0.7 | 0.04 | 0.005 | 16.0 | 0.015 | 0.04 | — | Co: 0.13 | Example |
| M | 0.03 | 0.25 | 0.9 | 0.02 | 0.004 | 16.5 | 0.008 | 0.03 | 0.2 | REM: 0.04 | Example |
| AB | 0.007 | 0.18 | 0.77 | 0.03 | 0.004 | 16.3 | 0.005 | 0.03 | — | | Example |
| AC | 0.022 | 0.20 | 0.09 | 0.04 | 0.006 | 16.6 | 0.004 | 0.04 | — | | Example |
| AD | 0.023 | 0.15 | 0.76 | 0.03 | 0.005 | 15.6 | 0.005 | 0.03 | — | | Example |
| AE | 0.025 | 0.19 | 0.78 | 0.04 | 0.004 | 16.1 | 0.003 | 0.04 | — | | Example |
| AF | 0.024 | 0.20 | 0.81 | 0.03 | 0.004 | 16.3 | 0.004 | 0.04 | 0.5 | V: 0.05, Ti: 0.008, Nb: 0.044 | Example |
| AG | 0.021 | 0.21 | 0.25 | 0.03 | 0.005 | 16.2 | 0.005 | 0.03 | — | | Example |
| AH | 0.020 | 0.14 | 0.26 | 0.04 | 0.006 | 16.5 | 0.005 | 0.04 | 0.1 | V: 0.11 | Example |
| AI | 0.023 | 0.18 | 0.79 | 0.02 | 0.004 | 16.3 | 0.003 | 0.04 | — | Ti: 0.023, Ca: 0.0004 | Example |
| AJ | 0.022 | 0.34 | 0.34 | 0.02 | 0.005 | 16.1 | 0.028 | 0.03 | 0.2 | | Example |
| AK | 0.021 | 0.31 | 0.22 | 0.03 | 0.003 | 16.0 | 0.005 | 0.03 | 0.1 | | Example |
| AL | 0.022 | 0.26 | 0.27 | 0.03 | 0.004 | 16.3 | 0.003 | 0.04 | | Cu: 0.3 | Example |
| AM | 0.022 | 0.34 | 0.35 | 0.02 | 0.004 | 16.1 | 0.005 | 0.03 | | | Example |
| AN | 0.016 | 0.29 | 0.26 | 0.03 | 0.002 | 16.2 | 0.004 | 0.02 | | V: 0.08 | Example |
| AO | 0.019 | 0.25 | 0.24 | 0.03 | 0.004 | 17.7 | 0.007 | 0.03 | | Mg: 0.0015 | Example |
| AP | 0.022 | 0.32 | 0.28 | 0.04 | 0.004 | 15.6 | 0.002 | 0.03 | | Nb: 0.025, REM: 0.01 | Example |
| AQ | 0.018 | 0.26 | 0.30 | 0.02 | 0.004 | 16.2 | 0.005 | 0.02 | 0.1 | Ti: 0.017, B: 0.0009, Ca: 0.0003 | Example |
| AR | 0.034 | 0.28 | 0.26 | 0.04 | 0.003 | 16.0 | 0.003 | 0.03 | | | Example |
| AS | 0.021 | 0.33 | 0.25 | 0.03 | 0.005 | 16.1 | 0.004 | 0.03 | | Mo: 0.3, Co: 0.19 | Example |
| N | 0.04 | 0.22 | 0.8 | 0.03 | 0.003 | 15.2 | 0.045 | 0.04 | — | | Comparative Example |
| O | 0.03 | 0.26 | 0.7 | 0.03 | 0.003 | 18.3 | 0.033 | 0.04 | 0.2 | | Comparative Example |
| P | 0.07 | 0.36 | 0.6 | 0.03 | 0.006 | 16.6 | 0.048 | 0.05 | — | | Comparative Example |
| Q | 0.005 | 0.27 | 0.9 | 0.04 | 0.005 | 16.2 | 0.021 | 0.06 | 0.2 | | Comparative Example |

Underlined items are outside the range of the present invention.

TABLE 2

| | | Hot-rolled Sheet Annealing | | | | | Maximum | Cold-rolled | |
|---|---|---|---|---|---|---|---|---|---|
| | | | | Cooling Rate from 350° C. | Area Fraction of Martensite | Microstructure other than | Hardness of Martensite | Sheet Annealing | |
| No. | Steel Code | Temperature [° C.] | Time [sec] | to 150° C. [° C./sec] | Phase [%] | Martensite Phase | Phase [HV] | Temperature [° C.] | Time [sec] |
| 1 | A | 922 | 58 | 2.5 | 29 | Ferrite Phase: 71% | 399 | 860 | 30 |
| 2 | A | 959 | 61 | 2.8 | 37 | Ferrite Phase: 63% | 391 | 864 | 30 |
| 3 | A | 903 | 90 | 3.4 | 14 | Ferrite Phase: 86% | 405 | 857 | 30 |
| 4 | B | 921 | 60 | 2.7 | 28 | Ferrite Phase: 72% | 405 | 861 | 30 |
| 5 | C | 923 | 57 | 2.0 | 29 | Ferrite Phase: 71% | 411 | 861 | 30 |
| 6 | C | 957 | 124 | 2.8 | 40 | Ferrite Phase: 60% | 416 | 864 | 30 |
| 7 | D | 925 | 63 | 2.2 | 32 | Ferrite Phase: 68% | 395 | 862 | 30 |
| 8 | E | 919 | 58 | 2.1 | 27 | Ferrite Phase: 73% | 394 | 860 | 30 |
| 9 | F | 923 | 60 | 3.5 | 28 | Ferrite Phase: 72% | 413 | 865 | 30 |
| 10 | G | 918 | 59 | 2.8 | 30 | Ferrite Phase: 70% | 394 | 860 | 30 |
| 11 | H | 922 | 61 | 4.2 | 32 | Ferrite Phase: 58% | 397 | 858 | 30 |
| 12 | I | 921 | 57 | 2.3 | 28 | Ferrite Phase: 72% | 414 | 863 | 30 |
| 13 | J | 926 | 61 | 3.1 | 27 | Ferrite Phase: 73% | 408 | 860 | 30 |
| 14 | K | 920 | 58 | 2.3 | 31 | Ferrite Phase: 69% | 405 | 858 | 30 |
| 15 | L | 917 | 60 | 1.4 | 29 | Ferrite Phase: 71% | 399 | 857 | 30 |
| 16 | M | 918 | 58 | 2.1 | 33 | Ferrite Phase: 57% | 404 | 856 | 30 |
| 39 | AB | 924 | 62 | 3.0 | 23 | Ferrite Phase: 77% | 354 | 863 | 30 |
| 40 | AC | 920 | 61 | 8.5 | 25 | Ferrite Phase: 75% | 380 | 852 | 30 |
| 41 | AD | 921 | 59 | 2.1 | 26 | Ferrite Phase: 74% | 378 | 859 | 30 |
| 42 | AE | 924 | 60 | 2.8 | 29 | Ferrite Phase: 71% | 422 | 860 | 30 |
| 43 | AF | 921 | 63 | 2.7 | 33 | Ferrite Phase: 67% | 424 | 857 | 30 |
| 44 | AG | 920 | 61 | 3.2 | 21 | Ferrite Phase: 79% | 409 | 863 | 30 |

TABLE 2-continued

| | | | | | | | | | |
|---|---|---|---|---|---|---|---|---|---|
| 45 | AH | 924 | 60 | 3.3 | 24 | Ferrite Phase: 76% | 406 | 851 | 30 |
| 46 | AI | 924 | 60 | 3.0 | 25 | Ferrite Phase: 75% | 399 | 881 | 30 |
| 47 | A | 922 | 6 | 2.7 | 19 | Ferrite Phase: 81% | 402 | 842 | 60 |
| 52 | AJ | 945 | 60 | 2.5 | 23 | Ferrite Phase: 77% | 401 | 862 | 30 |
| 53 | AK | 941 | 60 | 2.5 | 37 | Ferrite Phase: 63% | 407 | 863 | 30 |
| 54 | AL | 944 | 61 | 2.1 | 28 | Ferrite Phase: 72% | 414 | 850 | 30 |
| 55 | AM | 940 | 59 | 3.3 | 25 | Ferrite Phase: 75% | 407 | 851 | 30 |
| 56 | AN | 942 | 62 | 2.8 | 22 | Ferrite Phase: 78% | 368 | 858 | 30 |
| 57 | AO | 1018 | 58 | 2.5 | 15 | Ferrite Phase: 85% | 395 | 855 | 60 |
| 58 | AP | 941 | 59 | 2.8 | 27 | Ferrite Phase: 73% | 399 | 860 | 30 |
| 59 | AQ | 939 | 61 | 2.5 | 29 | Ferrite Phase: 71% | 408 | 858 | 30 |
| 60 | AR | 939 | 57 | 2.0 | 33 | Ferrite Phase: 67% | 415 | 857 | 30 |
| 61 | AS | 938 | 60 | 2.5 | 29 | Ferrite Phase: 72% | 405 | 861 | 30 |
| 17 | N | 917 | 58 | 2.7 | 34 | Ferrite Phase: 65% | 395 | 859 | 30 |
| 18 | O | 921 | 62 | 2.6 | 0 | Ferrite Phase: 100% | Unmeasurable | 862 | 30 |
| 19 | P | 923 | 62 | 2.7 | 29 | Ferrite Phase: 71% | 531 | 863 | 30 |
| 20 | Q | 919 | 62 | 3.2 | 7 | Ferrite Phase: 93% | 398 | 856 | 30 |
| 22 | A | 821 | 63 | 2.6 | 0 | Ferrite Phase: 100% | Unmeasurable | 860 | 30 |
| 25 | C | 927 | 61 | 13.4 | 37 | Ferrite Phase: 63% | 554 | 862 | 30 |
| 62 | B | 925 | 3 | 2.8 | 0 | Ferrite Phase: 100% | Unmeasurable | 861 | 30 |
| 63 | AK | 1065 | 62 | 2.4 | 65 | Ferrite Phase: 35% | 542 | 861 | 30 |
| 64 | AK | 821 | 60 | 2.3 | 0 | Ferrite Phase: 100% | Unmeasurable | 860 | 30 |
| 65 | AK | 919 | 3 | 2.5 | 0 | Ferrite Phase: 100% | Unmeasurable | 862 | 30 |
| 66 | AK | 961 | 1075 | 2.2 | 26 | Ferrite Phase: 75% | 521 | 858 | 30 |
| 67 | AK | 941 | 61 | 13.7 | 31 | Ferrite Phase: 69% | 544 | 858 | 30 |

| No. | Number of Seam Defects per 1 $m^2$ of Steel Sheet | Ductility | Average r-Value | Ridging Resistance | Corrosion Resistance | \|Δr\| | Note |
|---|---|---|---|---|---|---|---|
| 1 | 1 | ○ | ○ | ○ | ○ | ○ | Example |
| 2 | 0 | ○ | ○ | ○ | ○ | ○ | Example |
| 3 | 0 | ○ | ○ | ○ | ○ | ○ | Example |
| 4 | 0 | ○ | ○ | ○ | ○ | ○ | Example |
| 5 | 1 | ○ | ○ | ○ | ○ | ○ | Example |
| 6 | 1 | ○ | ○ | ○ | ○ | ○ | Example |
| 7 | 1 | ○ | ○ | ○ | ○ | ○ | Example |
| 8 | 0 | ○ | ○ | ○ | ○ | ○ | Example |
| 9 | 0 | ○ | ○ | ○ | ⊙ | ○ | Example |
| 10 | 2 | ○ | ○ | ○ | ⊙ | ○ | Example |
| 11 | 1 | ○ | ○ | ○ | ⊙ | ○ | Example |
| 12 | 3 | ○ | ○ | ○ | ⊙ | ○ | Example |
| 13 | 2 | ○ | ○ | ○ | ○ | ○ | Example |
| 14 | 3 | ○ | ○ | ○ | ○ | ○ | Example |
| 15 | 2 | ○ | ○ | ○ | ○ | ○ | Example |
| 16 | 1 | ○ | ○ | ○ | ○ | ○ | Example |
| 39 | 2 | ○ | ○ | ○ | ○ | ○ | Example |
| 40 | 0 | ○ | ○ | ○ | ○ | ○ | Example |
| 41 | 0 | ○ | ○ | ○ | ○ | ○ | Example |
| 42 | 0 | ○ | ○ | ○ | ○ | ○ | Example |
| 43 | 0 | ○ | ○ | ○ | ⊙ | ○ | Example |
| 44 | 1 | ○ | ○ | ○ | ○ | ○ | Example |
| 45 | 1 | ○ | ○ | ○ | ○ | ○ | Example |
| 46 | 0 | ○ | ○ | ○ | ○ | ○ | Example |
| 47 | 0 | ○ | ○ | ○ | ○ | ○ | Example |
| 52 | 0 | ⊙ | ○ | ○ | ○ | Δ | Example |
| 53 | 2 | ⊙ | ○ | ○ | ○ | Δ | Example |
| 54 | 0 | ⊙ | ○ | ○ | ⊙ | Δ | Example |
| 55 | 0 | ⊙ | ○ | ○ | ○ | Δ | Example |
| 56 | 1 | ⊙ | ○ | ○ | ○ | Δ | Example |
| 57 | 0 | ⊙ | ○ | ○ | ○ | Δ | Example |
| 58 | 3 | ⊙ | ○ | ○ | ○ | Δ | Example |
| 59 | 2 | ⊙ | ○ | ○ | ○ | Δ | Example |
| 60 | 0 | ⊙ | ○ | ○ | ○ | Δ | Example |
| 61 | 0 | ⊙ | ○ | ○ | ⊙ | Δ | Example |
| 17 | 2 | ○ | ○ | ○ | X | ○ | Comparative Example |
| 18 | 3 | ○ | X | X | ⊙ | Δ | Comparative Example |
| 19 | 27 | X | ○ | ○ | ○ | ○ | Comparative Example |
| 20 | 4 | ○ | X | X | ○ | Δ | Comparative Example |
| 22 | 1 | X | X | X | ○ | Δ | Comparative Example |
| 25 | 34 | ○ | ○ | ○ | ○ | ○ | Comparative Example |
| 62 | 1 | X | X | X | ○ | Δ | Comparative Example |

TABLE 2-continued

| | | | | | | | |
|---|---|---|---|---|---|---|---|
| 63 | 28 | ⊙ | ○ | ○ | ○ | Δ | Comparative Example |
| 64 | 2 | X | X | X | ○ | Δ | Comparative Example |
| 65 | 0 | X | X | X | ○ | Δ | Comparative Example |
| 66 | 17 | ⊙ | ○ | ○ | ○ | Δ | Comparative Example |
| 67 | 33 | ⊙ | ○ | ○ | ○ | Δ | Comparative Example |

Underlined items are outside the range of the present invention.

In Examples Nos. 1 to 16, 39 to 47, and 52 to 61 according to the present invention, the number of seam defects observed after the cold-rolled-sheet annealing was 5 or less per square meter in all samples, which means that excellent surface properties were obtained. In addition, it is confirmed that excellent formability was obtained since the elongation after fracture was 25% or more and the average r-value was 0.70 or more and it is also confirmed that ridging resistance was good. Moreover, regarding corrosion resistance, in all samples, the rust area fraction of one side of the test piece after 8 cycles of the salt spray cycle test was 25% or less, which means that good corrosion resistance was obtained.

In particular, in Example Nos. 1 to 16 and 39 to 47 in which the Si content was less than 0.25% or the Mn content was more than 0.35%, $|\Delta r|$ was 0.20 or less, which shows that formability was further improved.

In Nos. 52 to 61 in which the C content was 0.035% or less, the Si content was 0.25% or more and less than 0.40%, and the Mn content was 0.35% or less, the elongation after fracture was 27% or more, which means that the ductility was further improved. In steel G of No. 10 containing 0.4% of Cu, steel AL of No. 54 containing 0.3% of Cu, steel H of No. 11 containing 0.5% of Ni, steel AF of No. 43 also containing 0.5% of Ni, steel I of No. 12 containing 0.4% of Mo, and steel AS of No. 61 containing 0.3% of Mo, the rust area fraction after the salt spray cycle test was 10% or less, which shows that the corrosion resistance was further improved.

The microstructure of each of these hot-rolled sheets was investigated. The microstructure after hot-rolled-sheet annealing had 14% to 40%, of the martensite phase in terms of area fraction, and the results of hardness measurement confirmed that the hardness of the martensite phase was low, namely, HV424 at maximum. It was thus confirmed that all samples satisfied the conditions of the material for stainless steel cold rolling according to the present invention.

In No. 17 in which the Cr content was below the range of the present invention, desired surface properties, ductility, average r-value, and ridging resistance were obtained; however, since the Cr content was deficient, desired corrosion resistance was not obtained.

In No. 18 in which the Cr content was above the range of the present invention, sufficient corrosion resistance was obtained but the martensite phase was not generated because incorporation of excessive Cr obstructed formation of the austenite phase during hot-rolled-sheet annealing. Thus, the desired average r-value and ridging resistance could not be obtained.

In No. 19 in which the C content was above the range of the present invention, the hardness of the martensite phase did not sufficiently decrease although cooling in the temperature region of 350° C. to 150° C. was conducted at a prescribed cooling rate after hot-rolled-sheet annealing; as a result, hard martensite exceeding HV500 remained after hot-rolled-sheet annealing, and desired surface properties were not obtained. Moreover, since the amount of dissolved C was increased, the steel sheet strength rose significantly and the desired ductility could not be obtained.

In No. 20 in which the C content was below the range of the present invention, carbon (C) did not sufficiently stabilize the austenite phase and thus a sufficient amount of the austenite phase was not generated during hot-rolled-sheet annealing; thus, the desired amount of the martensite phase was not obtained after hot-rolled-sheet annealing and the desired average r-value and ridging resistance could not be obtained.

In No. 63 and No. 66, carbides dissolved during hot-rolled-sheet annealing and the C concentration excessively increased in the austenite phase. As a result, as with No. 19, significantly hard martensite exceeding HV500 remained after hot-rolled-sheet annealing, and desired surface properties were not obtained. In particular, in No. 63, edge cracking occurred during cold rolling.

In No. 22 and No. 64, the hot-rolled-sheet annealing temperature was in the ferrite single-phase temperature region, and, due to insufficient recrystallization, desired ductility was not obtained. Moreover, the martensite phase was not generated after hot-rolled-sheet annealing, and desired average r-value and ridging resistance were not obtained.

In No. 62 and No. 65, the hot-rolled-sheet annealing time was too short for sufficient recrystallization, and the desired ductility was not obtained; moreover, since the austenite phase was not generated during annealing, the martensite phase was not generated after hot-rolled-sheet annealing, and desired average r-value and ridging resistance were not obtained.

In No. 25 and No. 67, the generated martensite phase was insufficiently self-tempered; as a result, a hard martensite phase exceeding HV500 remained after hot-rolled-sheet annealing. Although the desired ductility, average r-value, ridging resistance, and corrosion resistance were obtained, desired surface properties were not obtained.

The above-described results confirm that as long as the material for stainless steel cold rolling according to the present invention is used, a cold-rolled ferritic stainless steel sheet that has desired surface properties, formability, and ridging resistance is easily obtained.

Example 2

Ingots of steels A and C described in Table 1 were each heated at 1150° C. for 1 hour and hot-rolled into a hot-rolled sheet having a thickness of 3.5 mm. Each hot-rolled sheet was subjected to hot-rolled-sheet annealing under conditions described in Table 3, the surface was de-scaled through a shot blasting treatment and pickling so as to obtain a hot-rolled and annealed sheet. In the temperature region of 350° C. to 150° C. during the cooling process after the hot-roll annealing, the cooling rate was 2 to 5° C./sec. The resulting hot-rolled and annealed sheet was cold rolled and annealed under conditions described in Table 3, and then the resulting sheet was descaled by pickling so as to obtain a cold-rolled and annealed sheet.

A test specimen for microstructural observation was taken from a center portion of the hot-rolled and annealed sheet in the width direction. A section taken from the test specimen in the rolling direction was mirror-polished and corroded (etched) with a hydrochloric-picric acid solution. The center portion in the thickness direction of the section was observed with an optical microscope at a magnification of 400. Photographs of ten view areas were taken. For each microstructure photograph, the martensite phase and ferrite phase were identified and separated based on metallographic features, the area fraction of the martensite phase was measured by using an image analyzer, and the average of ten view areas was assumed to be the area fraction of the martensite phase of that hot-rolled and annealed sheet. In measuring the area fraction, precipitates (carbides and nitrides) and inclusions were excluded.

The hardness was measured from a test specimen for microstructural observation taken from a center portion of the hot-rolled and annealed sheet in the width direction. A section of the test specimen taken in the rolling direction was mirror-polished and corroded (etched) with a hydrochloric-picric acid solution. Then the martensite phase and ferrite phase were identified with an optical microscope equipped in a micro Vickers hardness meter based on the metallographic features. For the martensite phase, a total of 100 crystal grains were measured for each sample with a 1 g load and for a loading time of 5 seconds. The maximum hardness of each specimen is shown in Table 3.

The ductility, average r-value, |Δr|, ridging resistance, and corrosion resistance of the obtained cold-rolled and annealed sheets were evaluated by the same procedures as those described in Example 1.

As shown in Table 3, Nos. 26 to 33 and 48 to 50, which are examples of the present invention, all hot-rolled and annealed sheets contained 19% to 37% of the martensite phase in terms of area fraction, and the hardness of the martensite phase was low, namely, HV404 to HV425 at maximum, thereby satisfying the conditions of the material for cold rolling according to the present invention. The material for cold rolling was cold-rolled at various cold rolling reductions and finish-annealed. At any cold rolling reduction, |Δr| of 0.10 or less was obtained and the in-plane anisotropy was small. Moreover, |Δr| remained substantially constant within the margin of 0.02 even when the cold rolling reduction was changed from 49 to 89%. This shows that |Δr| is substantially independent from the cold rolling reduction.

The above-described results show that when a material for cold rolling containing less than 0.25% of Si or more than 0.35% of Mn is used in the present invention, a cold-rolled ferritic stainless steel sheet in which r-values in all tensile directions, average r-value, and |Δr| are substantially independent from the cold rolling reduction is obtained.

The material for cold-rolled stainless steel sheets obtained in the present invention is suitable as a material for ferritic stainless steel used in press products formed mainly by drawing and applications that require highly aesthetically appealing surfaces, e.g., kitchen instruments and plateware.

The invention claimed is:

1. A material for a cold-rolled stainless steel sheet, the material having a chemical composition containing, by mass %, C: 0.007% or more and 0.035% or less, Si: 0.25% or more and less than 0.40%, Mn: 0.05% or more and 0.35% or less, P: 0.04% or less, S: 0.01% or less, Cr: 15.5% or more

TABLE 3

| No. | Steel Code | Hot-rolled Sheet Annealing Temperature [° C.] | Hot-rolled Sheet Annealing Time [sec] | Area Fraction of Martensite Phase [%] | Microstructure other than Martensite Phase | Maximum Hardness of Martensite Phase [HV] | Cold-Rolled Steel Sheet Thickness [mm] | Cold Rolling Reduction [%] |
|---|---|---|---|---|---|---|---|---|
| 26 | A | 882 | 60 | 26 | Ferrite Phase: 74% | 413 | 1.79 | 49 |
| 27 | A | 881 | 60 | 19 | Ferrile Phase: 81% | 415 | 1.40 | 60 |
| 28 | A | 880 | 60 | 22 | Ferrite Phase: 78% | 405 | 1.02 | 71 |
| 29 | A | 880 | 60 | 27 | Ferrite Phase: 73% | 410 | 0.70 | 80 |
| 30 | A | 881 | 60 | 22 | Ferrite Phase: 78% | 416 | 0.39 | 89 |
| 31 | C | 881 | 60 | 31 | Ferrite Phase: 69% | 424 | 1.79 | 49 |
| 32 | C | 882 | 60 | 34 | Ferrite Phase: 66% | 404 | 0.98 | 72 |
| 33 | C | 880 | 60 | 33 | Ferrite Phase: 67% | 423 | 0.67 | 81 |
| 48 | A | 924 | 60 | 29 | Ferrite Phase: 71% | 418 | 0.63 | 82 |
| 49 | A | 941 | 60 | 27 | Ferrite Phase: 73% | 412 | 0.70 | 80 |
| 50 | C | 923 | 60 | 37 | Ferrite Phase: 63% | 425 | 0.67 | 81 |

| No. | Cold-Rolled Sheet Annealing Temperature [° C.] | Cold-Rolled Sheet Annealing Time [sec] | Ductility | Average r-Value | Ridging Resistance | Corrosion Resistance | \|Δr\| | Note |
|---|---|---|---|---|---|---|---|---|
| 26 | 863 | 30 | ○ | 0.96 | ○ | ○ | 0.07 | Example |
| 27 | 864 | 30 | ○ | 0.76 | ○ | ○ | 0.08 | Example |
| 28 | 861 | 30 | ○ | 0.85 | ○ | ○ | 0.08 | Example |
| 29 | 861 | 30 | ○ | 0.78 | ○ | ○ | 0.09 | Example |
| 30 | 862 | 30 | ○ | 1.00 | ○ | ○ | 0.08 | Example |
| 31 | 862 | 30 | ○ | 0.88 | ○ | ○ | 0.08 | Example |
| 32 | 860 | 30 | ○ | 0.91 | ○ | ○ | 0.07 | Example |
| 33 | 859 | 30 | ○ | 0.80 | ○ | ○ | 0.09 | Example |
| 48 | 840 | 60 | ○ | 0.81 | ○ | ○ | 0.08 | Example |
| 49 | 861 | 30 | ○ | 0.83 | ○ | ○ | 0.09 | Example |
| 50 | 860 | 30 | ○ | 0.78 | ○ | ○ | 0.06 | Example |

and 18.0% or less, Al: 0.001% or more and 0.10% or less, N: 0.01% or more and 0.06% or less, and the balance being Fe and inevitable impurities, the material having a metallographic structure including, in terms of area ratio, 10% or more and 60% or less of a martensite phase and the balance being a ferrite phase, wherein the hardness of the martensite phase is HV500 or less, wherein the material having the chemical composition further containing, by mass %, one, two, or more selected from the group consisting of V: 0.01% or more and 0.25% or less, Ti: 0.001% or more and 0.10% or less, Nb: 0.001% or more and 0.10% or less, Mg: 0.0002% or more and 0.0050% or less, B: 0.0002% or more and 0.0050% or less, REM: 0.01% or more and 0.10% or less, and Ca: 0.0002% or more and 0.0020% or less.

2. The material for a cold-rolled stainless steel sheet according to claim 1, the chemical composition further containing, by mass %, one, two, or more selected from the group consisting of Cu: 0.1% or more and 1.0% or less, Ni: 0.1% or more and 1.0% or less, Mo: 0.1% or more and 0.5% or less, and Co: 0.01% or more and 0.2% or less.

3. A method for manufacturing a material for a cold-rolled stainless steel sheet, comprising performing hot rolling on a steel slab having the chemical composition according to claim 1 and subsequently performing annealing including holding the hot-rolled steel sheet in a temperature range of 880° C. or higher and 1050° C. or lower for 5 seconds or more and 15 minutes or less and then cooling the held steel sheet at a cooling rate of 10° C./sec. or less in a temperature range of 350° C. or lower and 150° C. or higher.

4. A method for manufacturing a material for a cold-rolled stainless steel sheet, comprising performing hot rolling on a steel slab having the chemical composition according to claim 2 and subsequently performing annealing including holding the hot-rolled steel sheet in a temperature range of 880° C. or higher and 1050° C. or lower for 5 seconds or more and 15 minutes or less and then cooling the held steel sheet at a cooling rate of 10° C./sec. or less in a temperature range of 350° C. or lower and 150° C. or higher.

* * * * *